United States Patent [19]

Lebeau

[11] Patent Number: 4,951,987

[45] Date of Patent: Aug. 28, 1990

[54] REFUSE COLLECTING TOOL

[76] Inventor: Jean G. Lebeau, Pte. Gatineau, Quebec, Canada J8T 6B9

[21] Appl. No.: 421,671

[22] Filed: Oct. 16, 1989

[51] Int. Cl.[5] ..... A01K 29/00; E01H 1/12

[52] U.S. Cl. ..... 294/1.4; 294/50.8; 294/116

[58] Field of Search ..... 294/1.3–1.5, 294/11, 16, 19.1, 22, 28, 31.1, 50.5, 50.8, 55, 100, 115, 116; 15/104.8, 257.1, 257.6, 257.7

[56] References Cited

U.S. PATENT DOCUMENTS

| | | | |
|---|---|---|---|
| 1,220,481 | 3/1917 | Wedge | 294/115 |
| 1,457,198 | 5/1923 | Utley | 294/115 |
| 1,501,965 | 7/1924 | Moors | 294/50.8 X |
| 2,028,680 | 1/1936 | Mayeda et al. | 294/50.8 |
| 2,929,363 | 12/1960 | Kahan | 294/1.4 |
| 3,139,299 | 6/1964 | Bowen | 294/1.4 |
| 3,194,597 | 7/1965 | Lasch | 294/1.4 X |
| 3,328,066 | 6/1967 | Johnston | 294/1.4 X |
| 3,576,342 | 4/1971 | Page | 294/100 X |
| 3,617,084 | 11/1971 | Mares | 294/1.4 |
| 3,738,697 | 7/1973 | Kahan | 294/1.4 |
| 3,841,686 | 10/1974 | Gallo et al. | 294/1.4 |
| 3,977,422 | 8/1976 | Cabaluna | 294/1.4 X |
| 4,056,278 | 11/1976 | Bau et al. | 294/1.4 |
| 4,179,145 | 12/1979 | Shinsako | 294/1.4 |
| 4,194,777 | 3/1980 | Carns | 294/1.4 |
| 4,225,174 | 9/1980 | Hennessy et al. | 294/1.4 |
| 4,247,139 | 1/1981 | Grieb | 294/1.4 |
| 4,248,468 | 2/1981 | Hastings | 294/1.4 |
| 4,398,759 | 8/1983 | Manola | 294/1.4 |
| 4,741,566 | 5/1988 | Byung-Do et al. | 294/1.4 |

FOREIGN PATENT DOCUMENTS

| | | | |
|---|---|---|---|
| 2095156 | 9/1982 | United Kingdom | 294/1.4 |

*Primary Examiner*—Johnny D. Cherry
*Attorney, Agent, or Firm*—Bailey & Hardaway

[57] ABSTRACT

A refuse collecting tool for the sanitary collection of animal excrement or other refuse which is preferably not handled directly. The device includes a tubular handle having a gripping portion attached to its upper end and a scoop, elliptical in cross-section, attached to its lower end. The scoop is divided into opposing jaws which are hinged together along their top edges and constantly urged to a closed condition by coil springs attached to their end walls. A rod extending through the tubular handle is provided on its top end with a lever which extends radially through slots in the tubular handle that are located beneath the gripping portion, and on its other end with a flat rectangular plate sized to fit within the center region of the closed scoop. Upward pressure on the lever forces the opposing jaws of the scoop open as the rectangular plate is forced upwardly into the decreasing diameter of the top of the scoop. The rectangular plate also prevents collected refuse from entering and fouling the moving parts of the device tool. The advantage of the tool is its simple construction which renders it light weight, reliable in use, economical to manufacture and practically maintenance free.

4 Claims, 2 Drawing Sheets

REFUSE COLLECTING TOOL

The present invention relates to manually operated refuse collecting devices, and, in particular, to a simplified, reliable construction for a manually operated refuse collector.

BACKGROUND OF THE INVENTION

Refuse collectors, useful for the collection of animal excrement or other refuse which is preferably not handled directly, are well known in the art. The following U.S. patents are known to disclose such devices:

| | |
|---|---|
| 3,328,066 - Johnson | 3,617,084 - Mares |
| 3,738,697 - Kahn | 3,841,686 - Gallo et al. |
| 3,929,363 - Kahan | 3,977,422 - Cavaluna |
| 4,056,278 - Bau et al. | 4,179,145 - Shinsako |
| 4,194,777 - Carns | 4,225,174 - Hennessy et al. |
| 4,247,139 - Grieb | 4,248,468 - Hastings |
| 4,398,759 - Manola | 4,741,566 - Byung-do et al. |

Most of the above-listed U.S. patents disclose variations of a scoop device connected to an elongated, generally tubular handle, which device is used for the collection of refuse. One collective disadvantage of these prior art devices is the relative complexity of their design and the consequent relative expense of manufacturing them.

SUMMARY OF THE INVENTION

It is an object of the present invention to provide a refuse collecting tool which is simple to construct and inexpensive to manufacture.

It is a further object of the invention to provide a refuse collecting tool which requires a minimum of moving parts and therefore a minimum of maintenance.

A refuse collecting tool in accordance with the invention includes a tubular handle provided with a grip on its top end. The tubular handle houses a shaft which is movable within the handle and is provided on its top end with a lever that projects radially through slots provided in the handle beneath the grip. A scoop, substantially elliptical in cross section, having end walls is attached to the lower end of the handle. The scoop is divided along a plane coincident with the major axis of its elliptical cross-section into identical opposing jaws which are hinged together along their top longitudinal edges. Coil springs connected to each end wall of the opposing jaws urge the jaws to a closed condition. A flat rectangular plate, affixed to the lower end of the shaft and sized to fit closely within the central region of the closed scoop, forces the jaws to an open condition when the lever is raised by the squeezing action of a user's hand.

In more specific terms, a refuse collecting tool in acordance with the invention comprises:

a scoop for receiving refuse, having side walls and end walls which define a closed hollow elongated scoop that is subsantially elliptical in cross-section, the scoop being divided along a plane coincident with the major axis of its elliptical cross-section into opposing jaws which are hinged together along one of their adjacent longitudinal edges;

means for urging the jaws of the scoop to a closed condition;

a tubular handle having a grippable region on its top end and attachment means on its opposite end for affixing the handle to the hinged edge of the jaws of the scoop;

means for opening the scoop located therewithin and displaceable from a position wherein the scoop is closed to a position wherein said means simultaneously contacts the upper regions of the interior walls of the opposing jaws for the scoop to force the jaws outwardly to an open condition;

a lever for opening the scoop which is disposed beneath the grippable region of the top of the tubular handle; and a linkage interconnecting the lever and said means for opening the scoop, whereby upward pressure on the lever moves the linkage to urge said means up upwardly to force the opposed jaws of the scoop to an open condition.

BRIEF DESCRIPTION OF THE DRAWINGS

A preferred embodiment of the invention will now be explained by way of example only and with reference to the following drawings wherein.

DETAILED DESCRIPTION OF THE PREFERRED EMBODIMENT

Figure 1:
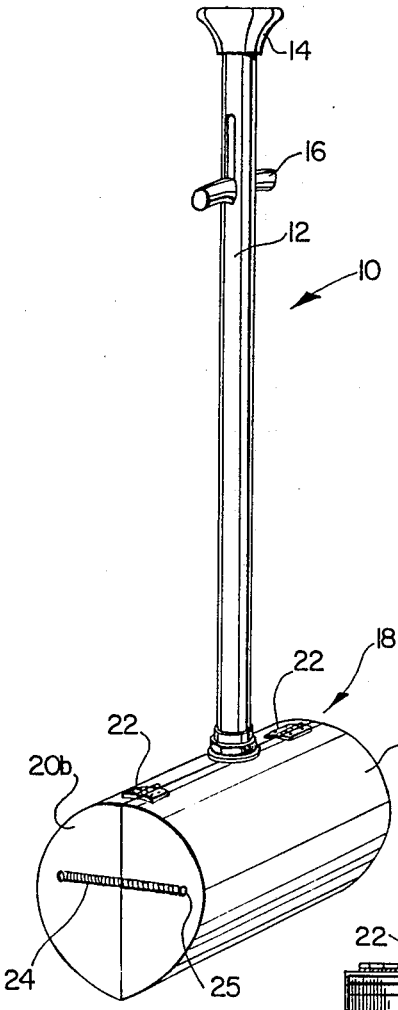
FIG. 1 is a perspective view of a refuse collecting tool in accordance with the invention.

A refuse collecting tool for the sanitary collection of animal excrement or other refuse which is preferably not handled directly, is generally indicated by the reference 10, as shown in FIG. 1. A preferred embodiment of the device includes a hollow handle member 12 which is provided with a cap or grippable region 14 on its top end and a lever 16 for opening the scoop, generally indicated by reference 18. The scoop 18 is substantially elliptical in cross-section and divided along a plane coincident with the major axis of its elliptical cross-section into two opposing jaws **20*a* and 20*b*. The jaws are hinged together along their opposing top edges by a pair of hinges 22. Jaws 20*a* and 20*b* are constantly urged to a closed condition by a pair of springs 24 connected respectively across each end wall of the scoop 18. The springs 24 may be secured to the jaws 20*a* and 20*b* with bolts 25** (as illustrated) or by lugs or eyelets molded as an integral part of the end walls of each jaw.

Figure 2:
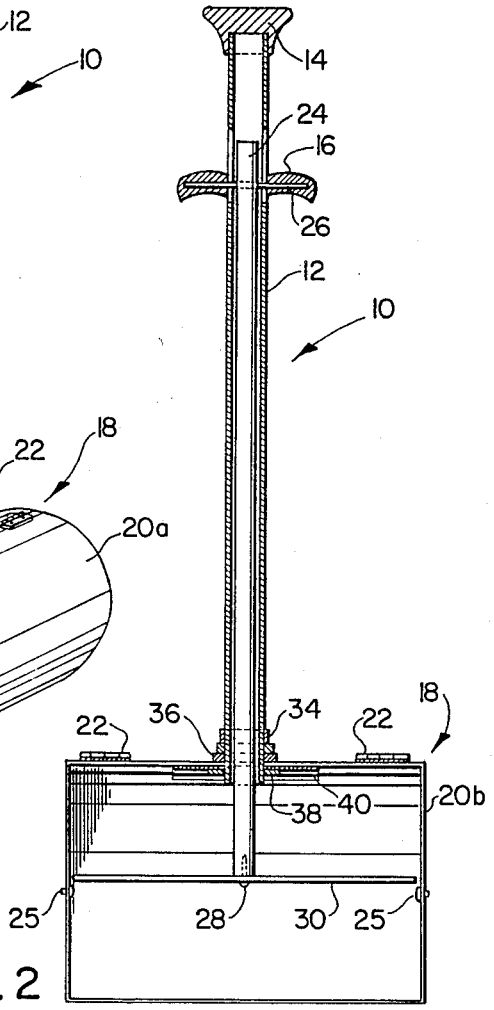
FIG. 2 is a longitudinal cross-section of the tool shown in FIG. 1.

FIG. 2 shows the refuse collecting device 10 in longitudinal cross-section. As is apparent, the hollow tubular handle 12 houses a shaft 24 which is connected to lever 16 by a pin 26. The shaft 24 may be a plastic or wooden dowel sized to be slidable within the tubular handle 12. The lever 16 may, of course, be affixed to shaft 24 by a number of alternate fastening methods including glue, screws, or similar fasteners. Shaft 24 is connected on its lower end by a screw 28, or some equivalent fastener, to a rectangular plate 30. The function of the rectangular plate 30 is described below in reference to FIGS. 3 and 4.

Figure 3:
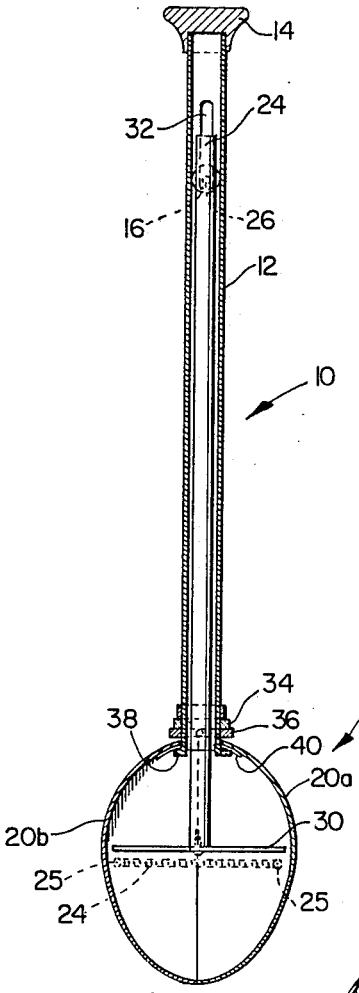
FIG. 3 is a transverse cross-section of the tool shown in FIG. 1 with the scoop in a closed condition.
Figure 4:
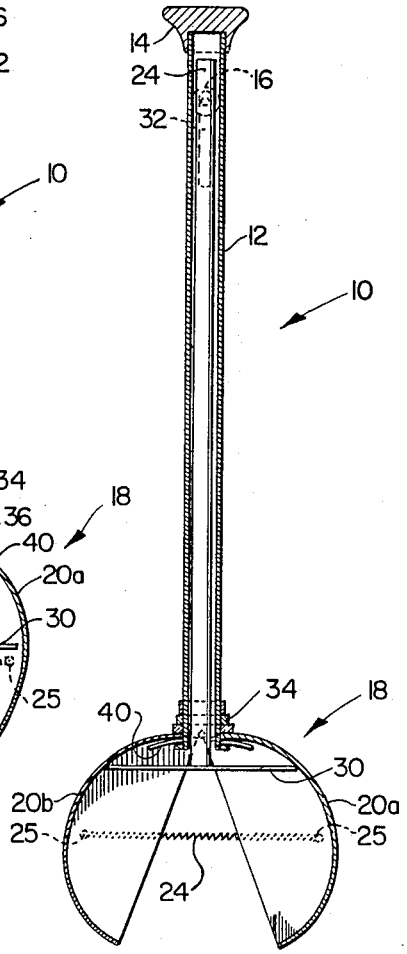
FIG. 4 is a transverse cross-section of the tool shown in FIG. 1 with the scoop in an open condition.

As shown in FIG. 3, handle 12 is provided with a vertical slot 32 which permits lever 16 to be raised toward the grip 14 by a gripping pressure applied by a user's hand. Upward pressure on the lever 16 raises shaft 24 within tubular handle 12 and likewise raises rectangular plate 30 within the scoop 18. As rectangular plate 30 is forced into the increasingly restricted space defined by the inner walls of the scoop 18, the opposing jaws 20*a* and 20*b* of the scoop are forced outwardly against the tension of coil springs 24. When the lifting pressure on lever 16 is released, the tension of coil springs 24 forces rectangular plate 30 downwards and closes opposing jaws 20*a* and 20*b*.

In a preferred embodiment of the invention, tubular handle 12 is formed from a length of rigid plastic tubing, preferably PVC or ABS tubing. Glued to the lower end of tubular handle 12 is a pipe coupling 34 of the type provided with an external thread on its free end. Sandwiched between coupling 34 and scoop 18 is a compressible rubber washer 36. The tubular handle 12 is secured to the scoop 18 by a cup nut 38 (see FIG. 2). Sandwiched between cup nut 38 and the top walls of scoop 18 is a flexible sheet 40, preferably a plastic sheet, which extends longitudinally and laterally of cup nut 38 to provide stablility between the scoop 18 and the tubular handle 12. Many alternative connections between the tubular handle and the scoop are, of course, possible and obvious to those skilled in the art. Hinges 22 may be any convenient leaf hinge member screwed or glued to opposing jaws 20*a* and 20*b*. Alternatively, the hinge may be a plastic molded hinge, well known in the art, which is manufactured as a unitary part of jaws 20*a* and 20*b*.

The material of preference for the construction of the scoop 18 is a molded polyvinyl chloride, polyethylene, nylon or a similar rigid plastic; however cast or sheet formed metals may be used with success. The tubular handle 12 may likewise be formed from a metallic tube rather than a plastic pipe. As stated above, the shaft 24 is conveniently a wooden or plastic dowel cut to the proper length; however, an aluminum or copper tubing is also satisfactory. The rectangular plate 30 is preferably a rigid plastic such as nylon since such plastic materials tend to be self-lubricating and therefore minimize the wear on the inner walls of jaws 20*a* and 20*b*.

In use, the scoop is carried in one hand with grip 14 in the palm of the hand and the fingers clasped about lever 16. When animal excrement or some other refuse is to be collected, lever 16 is raised by squeezing pressure of the fingers. The plate 30 is thereby moved upwardly to force open jaws 20*a* and 20*b* (see FIG. 4). The open jaws are placed over the article to be collected and the lever 16 is released. Coil springs 24 force jaws 20and 20*b* to a closed condition, scooping up the refuse so that it can be carried to a disposal container or site where pressure on lever 16 opens the jaws and releases the refuse from the scoop. It should be noted that rectangular plate 30 is preferably sized to fit relatively closely within the walls of scoop 18 when the scoop is in its closed condition. The plate 30 therefore serves a dual purpose. It acts as an opening mechanism for the scoop and as a rigid diaphragm for preventing the entry of waste into the moving parts of the device.

Changes and modifications in the specifically described embodiments can be carried out without departing from the scope of the invention which is intended to be limited only by the scope of the appended claims.

I claim:

1. A manually operable refuse collecting tool comprising:

a scoop for receiving refuse, having side walls and end walls which define a closed hollow elongated scoop that is substantially elliptical in cross section, the scoop being divided along a plane coincident with the major axis of its elliptical cross-section into two opposed jaws which are hinged together along one of their adjacent longitudinal edges;

means for urging the jaws of the scoop to a closed condition;

a tubular handle having a grippable region on its top end and attachment means on its opposite end for affixing the handle to the hinged edge of the jaws of the scoop;

means for opening the scoop located therewithin and displaceable from a position wherein the scoop is closed to a position wherein said means for opening the scoop contacts the upper regions of the interior walls of the jaws of the scoop to force the jaws outwardly to an opened condition;

a lever for opening the scoop which is disposed beneath the grippable region on the top of the handle; and a linkage interconnecting the lever and said means for opening the scoop, whereby upward pressure on the lever moves the linkage to urge said means for opening the scoop upwardly to force the opposed jaws of the scoop outwardly to an open condition.

2. A refuse collecting tool as defined in claim 1 wherein said means for opening the scoop comprises a flat rectangular plate sized to fit longitudinally within the central region of the scoop in its closed condition, the plate being vertically displaceable toward the top region of the scoop so that the sides of the plate contact the opposing interior walls of the scoop when so displaced to force the jaws to an opened condition.

3. A refuse collecting tool as in claim 1 wherein the linkage comprises a shaft slidable within the tubular handle, the shaft being provide with a lever on its top end which projects laterally through vertical slots in the tubular handle and is fixed on its opposite end to said means for opening the scoop.

4. A manually operable refuse collecting tool comprising;

a scoop connected to a tubular handle provided with a grip on its top end;

the scoop having side walls and end walls which define a closed hollow elongated scoop that is substantially elliptical in cross-section and is divided along a plane coincident with the major axis of its elliptical cross-section into opposed jaws that are hinged together along their top longitudinal edges;

a spring respectively attached to the end wall of each jaw of the scoop, one spring being located on each end of the scoop for urging the scoop to a closed condition;

a rectangular plate for opening the scoop located within the interior of the scoop and sized to fit closely within the central region of the scoop approximate a longitudinal plane coincident with the minor axis of its elliptical cross-section when the scoop is in a closed condition; and a shaft which is vertically slidable in the tubular handle, the shaft being attached to the rectangular plate on its bottom end and proved with a laterally projecting lever which extends through slots in the tubular handle beneath the grip, whereby lifting pressure on the lever raises the rectangular plate within the scoop and thereby contacts the opposed interior walls of the jaws of the scoop to force the opposed jaws of the scoop outwardly to an open condition.

* * * * *